US007955222B1

(12) United States Patent
Hernandez

(10) Patent No.: US 7,955,222 B1
(45) Date of Patent: Jun. 7, 2011

(54) VERTICAL JUMP TRAINING APPARATUS

(76) Inventor: Rick S. Hernandez, Homer Glen, IL (US)

( * ) Notice: Subject to any disclaimer, the term of this patent is extended or adjusted under 35 U.S.C. 154(b) by 238 days.

(21) Appl. No.: 12/204,933

(22) Filed: Sep. 5, 2008

Related U.S. Application Data

(60) Provisional application No. 60/970,378, filed on Sep. 6, 2007.

(51) Int. Cl.
*A63B 21/00* (2006.01)

(52) U.S. Cl. ..... 482/14; 482/15

(58) Field of Classification Search ..... 482/14–16, 482/148, 83–90, 107
See application file for complete search history.

(56) References Cited

U.S. PATENT DOCUMENTS

| | | | | |
|---|---|---|---|---|
| 4,749,184 | A * | 6/1988 | Tobin | 462/87 |
| 5,050,866 | A * | 9/1991 | Fucci | 482/90 |
| 5,213,554 | A * | 5/1993 | Goldstein et al. | 482/52 |
| 5,286,241 | A * | 2/1994 | Petrakis | 482/87 |
| 5,509,432 | A * | 4/1996 | Peterson | 135/65 |
| 5,603,682 | A * | 2/1997 | Grider | 482/142 |
| 5,722,921 | A * | 3/1998 | Simonson | 482/100 |
| 2003/0079767 | A1* | 5/2003 | Schultz | 135/69 |
| 2004/0224826 | A1* | 11/2004 | O'Shea | 482/83 |

OTHER PUBLICATIONS http://www.jumpusa.com/vertec.htm, Date Unknown.
http://www.monstermarketplace.com/Sports/Landing4075a642.html, Date Unknown.

* cited by examiner

*Primary Examiner* — Jerome W Donnelly
(74) *Attorney, Agent, or Firm* — McAndrews, Held & Malloy, Ltd.

(57) ABSTRACT

A jump training apparatus including a sleeve, a pipe, and an arm. Floor standing embodiments may also include a base that may be operably connected to a weight holder. Wall mounted embodiments may include a mounting bracket, mounting plate, or mounting clamps, for example. At least a portion of the pipe may be slideably inserted into the sleeve. The pipe may be operably connected to the arm. The vertical height of the arm may be adjusted through the movement of the pipe relative to the sleeve. According to certain embodiments, when the arm is positioned at the desired vertical height, the position of the pipe may be secured by operably engaging a fastening element. At least a portion of the arm may be covered by a cushion.

13 Claims, 6 Drawing Sheets

VERTICAL JUMP TRAINING APPARATUS

RELATED APPLICATIONS

This patent application makes reference to, claims priority to and claims benefit from U.S. Provisional Patent Application Ser. No. 60/970,378, entitled "Vertical Jump Training Apparatus," filed on Sep. 6, 2007, the complete subject matter of which is hereby incorporated herein by reference, in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

Athletes are always attempting to improve their abilities on the field of endeavor. Such improvements typically take the form of not only practice, but also physical training. One important aspect of athletics, and often a focus of athletic training, is the height of an athlete's vertical jump.

Many traditional jumping training apparatuses are expensive, require the use of retriever sticks, and/or require the use of multiple weights to provide the apparatus with needed stability. Further, many of these devices are constructed from heavy materials, such as steel, which may make moving or storage of these apparatuses difficult. Further, there is the potential that the training athlete may be injured by inadvertently hitting or jumping into a portion of the hard steel apparatus.

BRIEF SUMMARY OF THE INVENTION

The present invention is directed to an improved jump training apparatus. According to certain embodiments of the present invention, the jump training apparatus may be a floor standing unit or wall mounted unit. The jump training apparatus of the present invention may include a sleeve, a pipe, and an arm. Certain embodiments in which the jump training apparatus is a floor standing apparatus may also include a base. A weight(s) may be secured to the base by a weight holder(s), the weight holder being operably connected to the base, such as by a mechanical fastener, adhesive, or weld, or by being screwed into the body or a segment of the base, for example. The base may have a variety of different configurations, including, but not limited to, triangular, square, and rectangular, among others.

In embodiments in which the jump training apparatus is a floor standing unit, the sleeve may be operably connected to a base. Alternatively, for wall mounted versions, the sleeve may be mechanically fastened or adhered to an adjacent wall, or may be operably connected to a wall, such as by a mounting plate, mounting bracket, mechanical fastener, or adhesive, for example.

The pipe may include a distal end and a proximate end. At least a portion of the distal end of the pipe may be slideably inserted into the sleeve. At least a portion of the pipe and the sleeve may be generally perpendicular to the ground and the base. The proximate end of the pipe may be operably connected to the arm, at least a portion of the arm being generally parallel to the ground and the base. At least a portion of the arm may be covered by a cushion. Further, the pipe may also be operably connected to an adjustment handle, which may be held or engaged when moving the pipe about the sleeve and adjusting the vertical distance between the floor or ground and the arm.

The pipe and/or sleeve may also include, or be operably connected to, an adjustment member. According to certain embodiments, the adjustment member may be holes, recesses, serrations, notches, tabs, slots, or grooves, that may be positioned on or in the pipe or sleeve, for example.

The position of the pipe relative to the sleeve may be secured by the operable engagement of the adjustment member with a fastener. The fastener may be a separate or integral part of the adjustment member. The fastener may take a variety of forms, including, but not limited to, a pin, bolt, screw, pawl mechanism, spring-loaded handle and push button, among others, for example.

Figure 1:
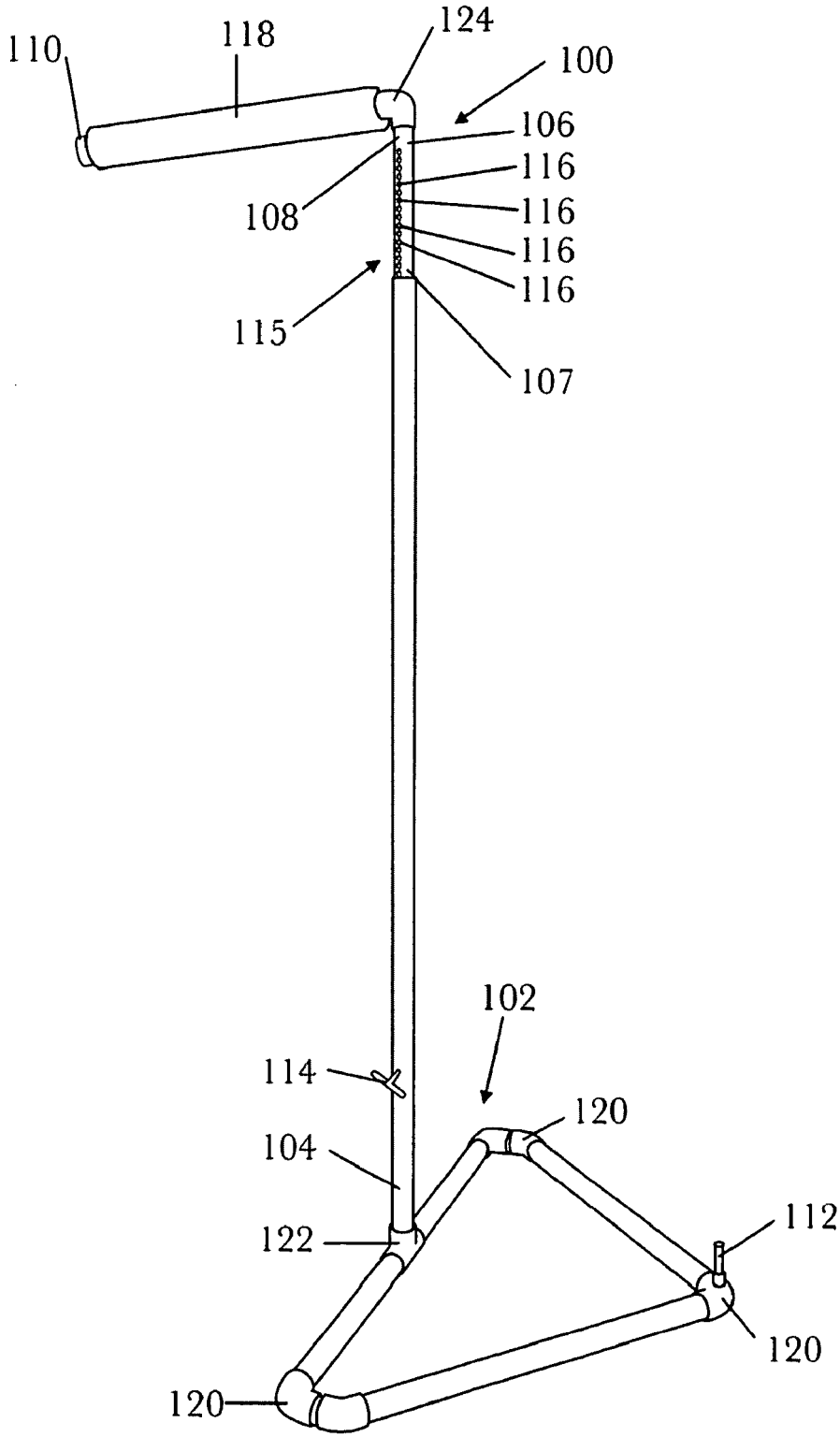
FIG. 1 illustrates a perspective view of a floor standing jump training apparatus according to one embodiment of the present invention.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentalities shown in the attached drawings.

DETAILED DESCRIPTION OF THE INVENTION

In the Figures, certain embodiments have common elements that are identified with common identifiers.

FIG. 1 illustrates a perspective view of a floor standing jump training apparatus 100 according to one embodiment of the present invention. The floor standing jump training apparatus 100 may include a base 102. The base 102 may include, or be operably connected to, a weight holder 112 that is configured to at least assist in securing a weight to or about the base 102. During operation, the inclusion of such a weight(s) may assist in stabilizing and/or generally retaining the position of the jump training apparatus 100 during operation. According to certain embodiments, the weight holder 112 may be constructed from metal, wood, rubber, plastic, or PVC, among others, and be approximately three inches in height. In other embodiments, for example, a weight holder can be approximately one inch in height. Further, the weight holder 112 may be operably secured to the base 102, such as being screwed, bolted, welded, or adhered into or onto the base 102. Additionally, the weight holder 112 may be configured to retain one or more weights of equal or different heaviness. However, according to embodiments of the present invention, desirable stability may be obtained by the use of one ten pound weight. In other embodiments, for example, a plurality of weights that weigh ten pounds or a different weight can be used.

The base 102 may be operably connected to a sleeve 104. According to embodiments of the present invention, at least a portion of the sleeve may be generally perpendicular to the ground. Further, at least a portion of the distal end 107 of a pipe 106 may be slideably inserted into the sleeve 104. Moreover, the inner diameter or inner region of the sleeve 104 may be slightly larger than the outer diameter or outer configuration of the pipe 106 so as to allow the pipe 106 to slide relative to the sleeve 104. For example, according to one embodiment of the present invention, the pipe 102 may be a generally cylindrical tube having an outer diameter of one inch, while at least a portion of the interior of the sleeve 104 may have a mating inner region that is one and one-quarter inches in diameter. Moreover, the outer region of the pipe 106 and the inner region of the sleeve 104 may have a variety of mating geometrical configurations, including circular, square, triangular, and oval, among others.

The position of the pipe 106 about the sleeve 104 may be adjustably secured by a fastener 114, such as a pin, bolt, or screw, push button, or pawl mechanism, among others, that operably engages an adjustment member 115. As previously stated, the fastener 114 may be an integral part of the adjustment member 115, or may be a separate component. According to certain embodiments, the adjustment member 115 may be a plurality of adjustment recesses or holes 116 that may be approximately equally spaced apart, as shown in FIG. 1. For example, adjustment holes 116 may be spaced in one-half inch increments along at least a portion of the pipe 106. Further, the adjustment holes 116 may have threads that mate a threaded portion of the fastener 114. According to such embodiments, the sleeve 104 may include at least one corresponding aperture (not shown). Conversely, according to other embodiments, the adjustment holes 116 may be positioned about the sleeve 104, and the pipe 106 may include at least one corresponding aperture. In operation, the insertion of a fastener 114, such as a pin, into both the aperture and an adjustment hole 116 may secure the position of the pipe 106 about the sleeve 104.

Alternatively, rather than being inserted into an adjustment hole 116, the fastener 114 may be turned to exert a compressive force against and/or into an outer sidewall of the pipe 106 that secures the position of the pipe 106 relative to the sleeve 104. According to other embodiments, the pipe 106 may include or be operably connected to a serrated portion. According to such an embodiment, the position of the pipe 106 may be secured by the at least one serration being engaged by a pawl mechanism that is operably connected to the sleeve 104. The pawl mechanism may be spring loaded so as to bias the pawl mechanism against a serration. According to another embodiment, at least one clamp may be used to compressively prevent the movement of the pipe 106 about the sleeve 104. Further, the fastener 114 may be a two pronged V-shaped push button that engages an adjustment member 115, wherein the adjustment member 115 that includes at least one groove that mates at least a portion of the push button.

The proximate end 108 of the pipe 106 may be operably connected to an arm 110. At least a portion of the arm 110 may be generally parallel to the ground. At least a portion of the arm 110 may also be covered by a cushion 118, such as foam and/or tape, among others.

Figure 2:
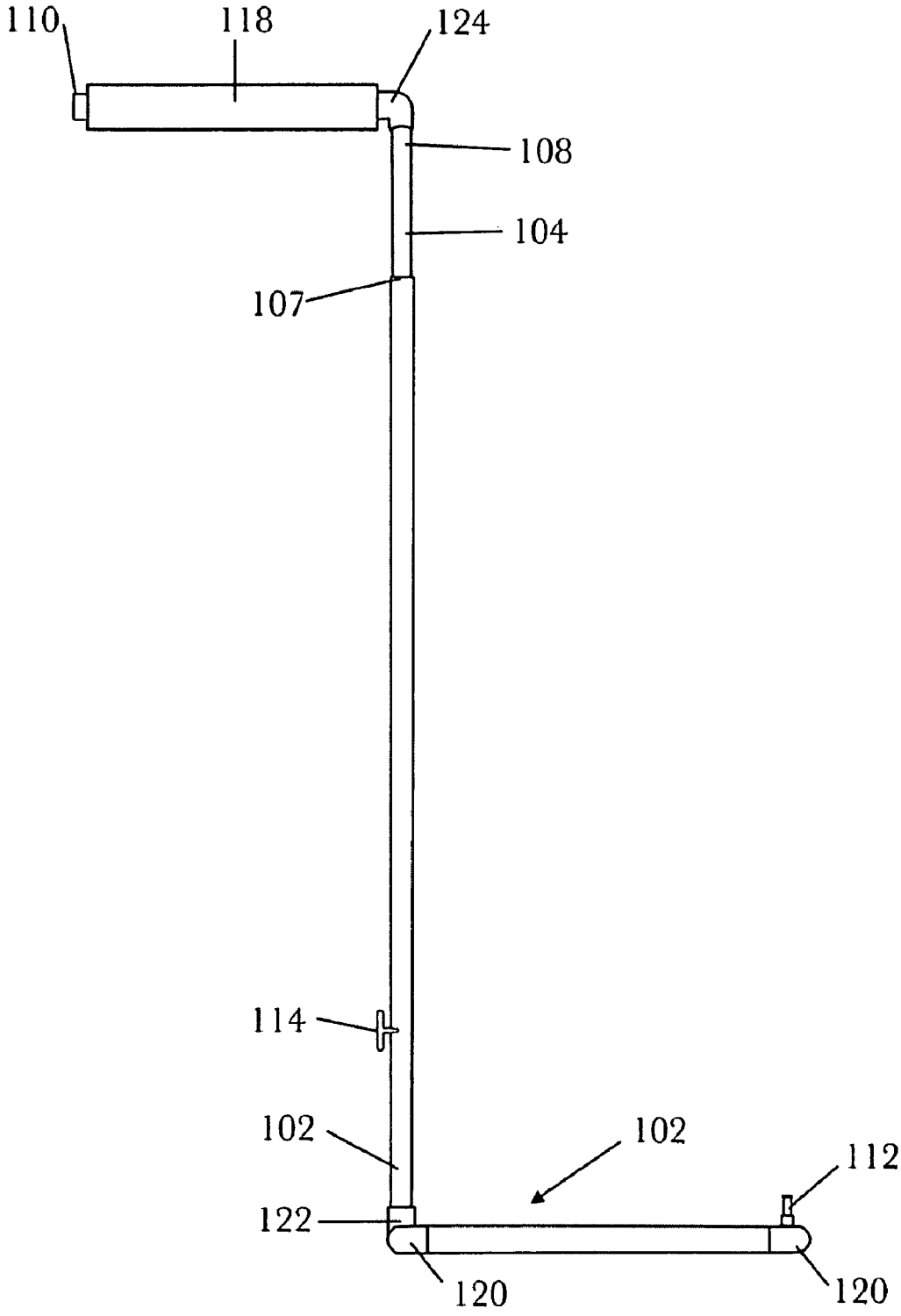
FIG. 2 illustrates a side view of a floor standing jump training apparatus according to one embodiment of the present invention.

FIG. 2 illustrates a side view of a floor standing jump training apparatus 100 according to one embodiment of the present invention. The jumping apparatus 100 of the present invention may be constructed from a variety of components, including, but not limited to, PVC tubing, plastic, metal, wood, and rubber. Although the base 102 may have a number of different geometric configurations, according to one embodiment, the base 102 may have a triangular configuration. For example, the base 102 may be constructed from segments of one and one-quarter inch diameter PVC tubing that are joined, such as through the use of mechanical fasteners and/or an adhesive, with 45 degree elbows 120 to form a triangular shape, as shown in FIG. 1.

The sleeve 104 may be connected to the base 102 through the use of a mechanical fastener and/or adhesive. According to one embodiment, the sleeve 104 may be a PVC tube that is joined to the base 102 through the use of a tee connector 122. Further, at least a portion of the tee connector 122 may be part of the base 102. For example, the sleeve 104 may be a one and one-quarter diameter six foot piece of PVC tubing. The tee 122 may be configured to receive the insertion of a portion of the sleeve 104 and segments from the base 102.

The pipe 106 and arm 110 may also be constructed from PVC tubing, for example one inch diameter pieces of six and two foot tubing, respectively. Further, the pipe 106 and arm 110 may be joined together by a ninety degree elbow 124. Alternatively, the pipe 106 and the arm 110 may be joined through the use of a mechanical fastener, such as a nut and a bolt, or a combination of a mechanical fastener and adhesive.

Figure 3:
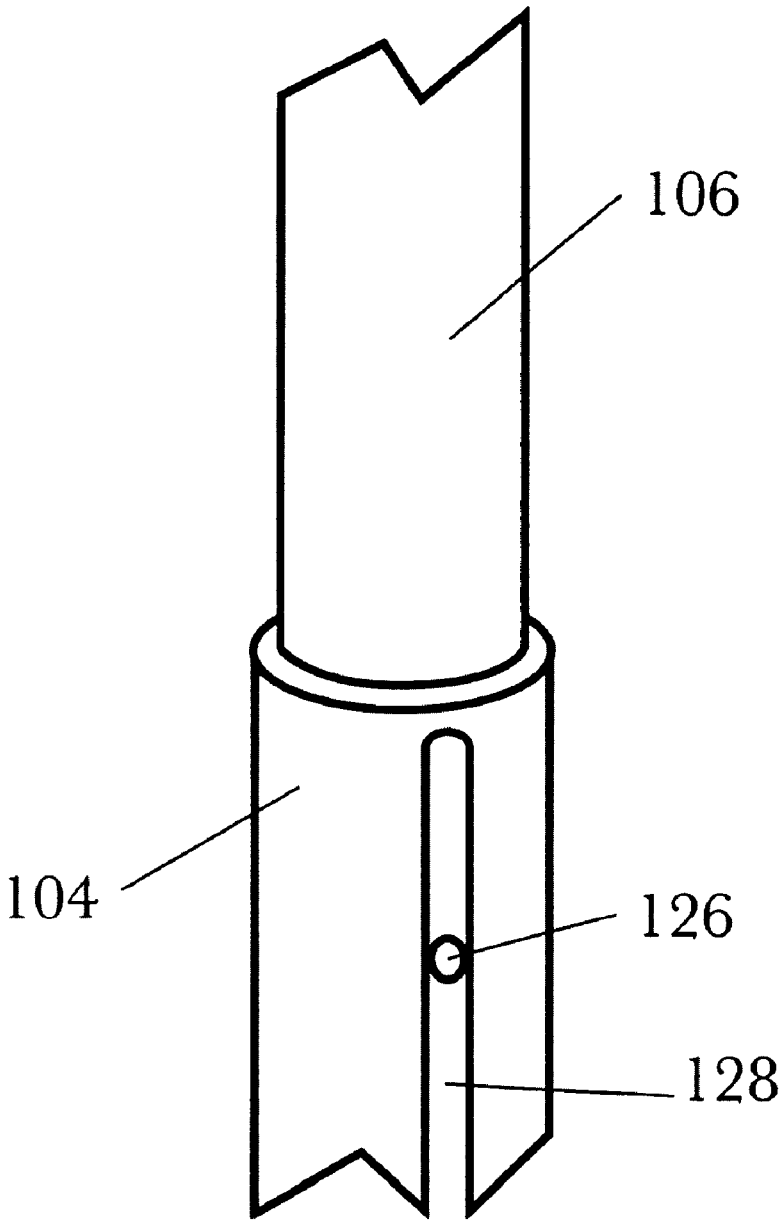
FIG. 3 illustrates an adjustment handle for a jumping apparatus according to one embodiment of the present invention.

FIG. 3 illustrates an adjustment handle 126 for a jumping apparatus 100 according to one embodiment of the present invention. The adjustment handle 126 may be operably connected to the pipe 106, for example through the use of a mechanical fastener, such as a bolt, pin, or screw, a threaded connection, a press fit, or an adhesive, among others. The adjustment handle 126 may assist in the ease of moving the pipe 106 relative to the sleeve 104. Moreover, in the embodiment illustrated in FIG. 3, the sleeve 104 may include a slot 128 through which the adjustment handle 126 may pass through and travel along as the vertical position of the pipe 106 is adjusted. However, according to other embodiments, the adjustment handle may be mounted to the pipe 106 above the sleeve 104.

During use, an individual may secure a weight, such as a ten pound weight, to the weight holder 112. The user may then grasp the adjustment handle 126 to move the pipe 106 relative to the stationary sleeve 104, and thereby adjust the vertical distance between the arm 110 and the ground. After the arm 110 has reached the desired vertical height, the position of the arm 110 may be secured by operably engaging the fastener 115 and the adjustment member 115. According to certain methods of operation, the user may initially set the arm 110 at a height at which the user may touch the cushion 118 with his arms fully extended while standing flat-footed. Alternatively, the initial height may be based on where the user's head touches the cushion 118. The user may then incrementally increase the vertical height of the arm 110 by inserting the fastener 114 into, and subsequently removing it from, the adjustment holes 116. After each adjustment in the height of the arm 110, the user may attempt to touch the arm 110, until the arm 110 is raised to a height that the user can no longer touch when jumping.

Figure 4:
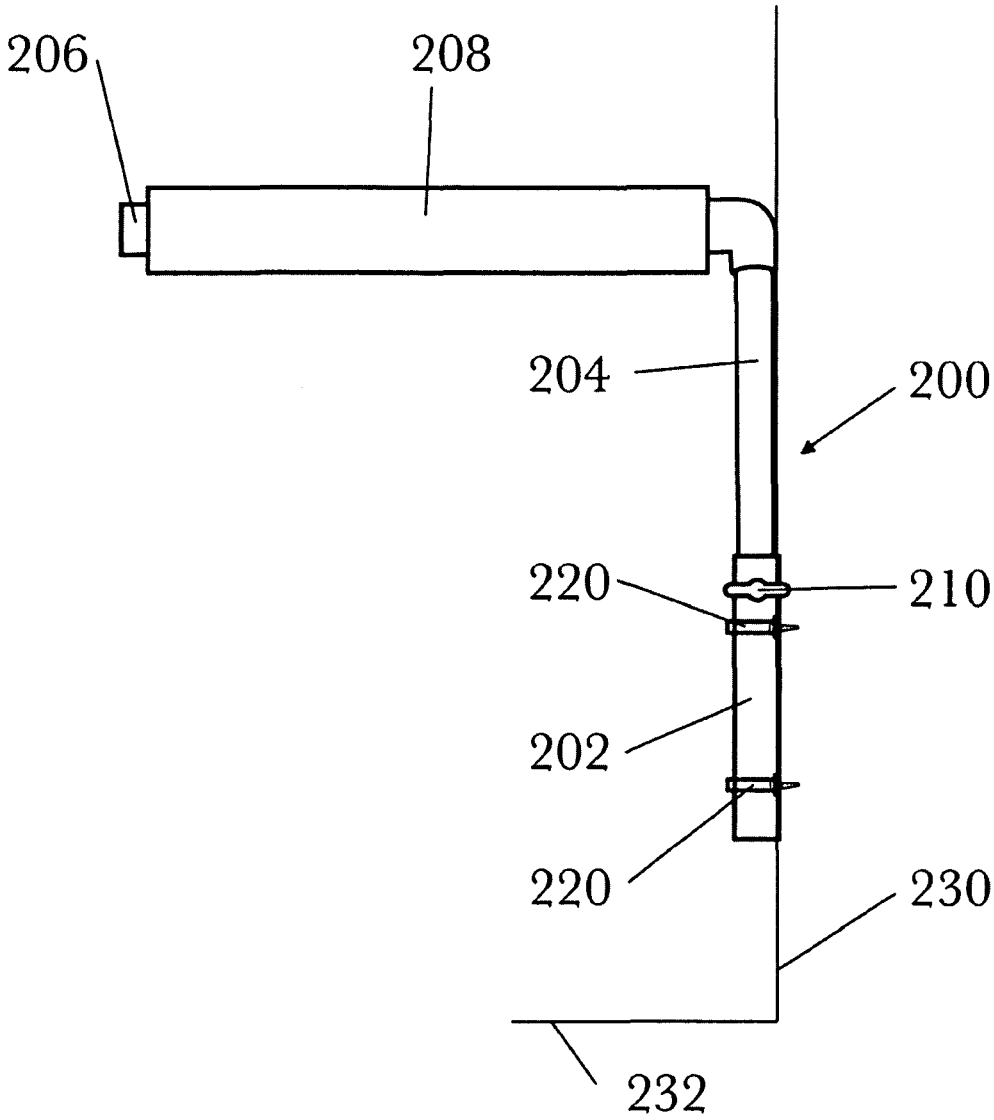
FIG. 4 illustrates a side view of a wall mounted jump training apparatus according to one embodiment of the present invention.

FIG. 4 illustrates a side view of a wall 230 mounted jump training apparatus 200 according to one embodiment of the present invention. The jump training apparatus 200 may include a sleeve 202, an pipe 204, a fastener 210, and an arm 206. A portion of the arm 206 may be covered by a cushion 208. Rather than having a base 102 that rests upon the floor 232, the wall mounted jump training apparatus 200 may operably secure the sleeve 202 to the wall through the use of a variety of fasteners and mounting apparatuses. For example, the sleeve 202 may be mounted to the wall 230 through the use of at least one clamp 220, the clamp 220 being operably connected to mechanical fasteners that are secured onto or into the wall 230. Alternatively, the jump training apparatus 200 may include mounting bracket(s) or a mounting plate(s) that is secured to the wall 230, and to which the jump training apparatus 200 is secured.

Figure 5:
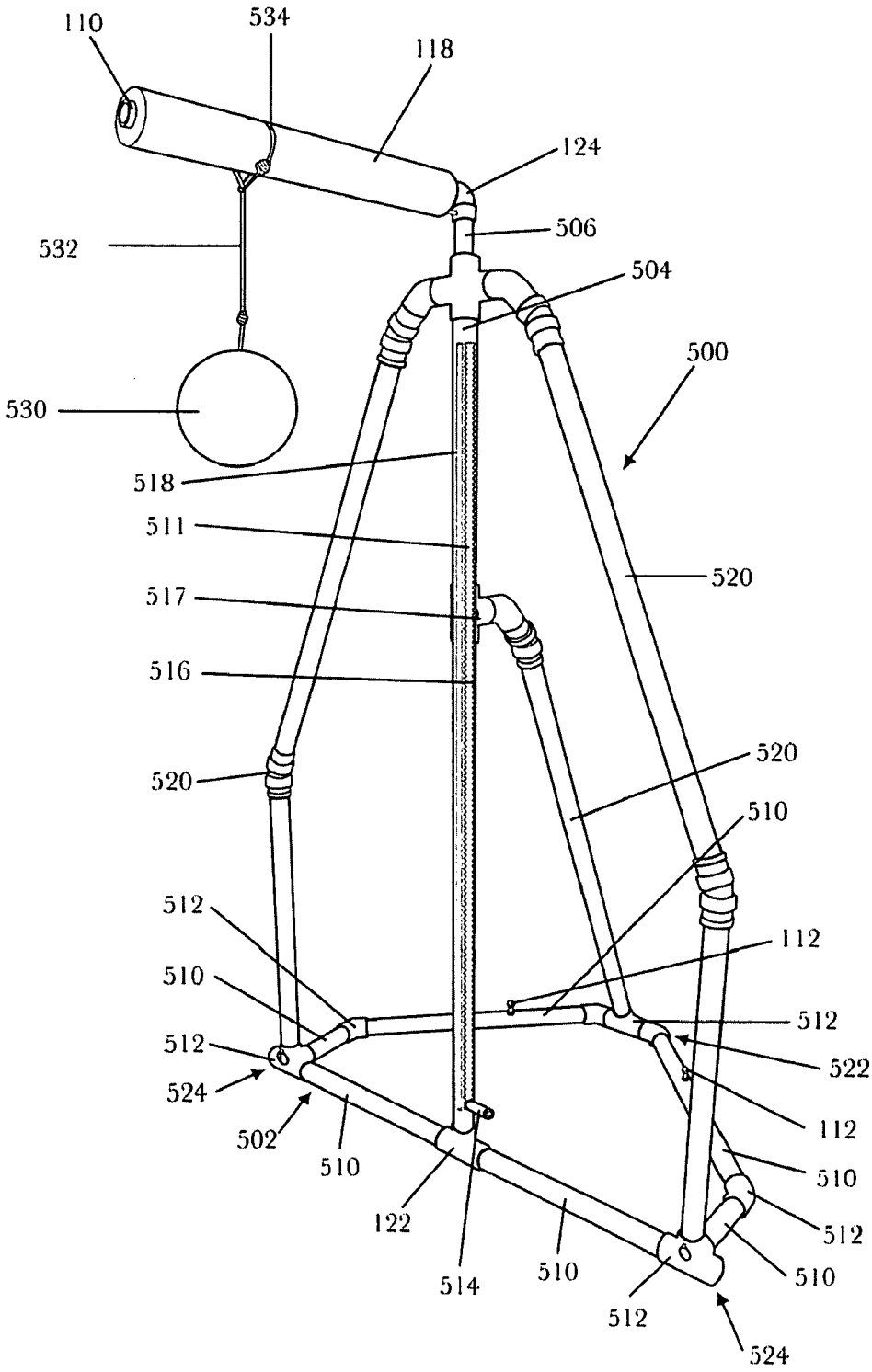
FIG. 5 illustrates a perspective view of a floor standing jump training apparatus according to one embodiment of the present invention.

FIG. 5 illustrates a perspective view of a floor standing jump training apparatus 500 according to one embodiment of the present invention. The floor standing jump training apparatus 500 includes a base 502 comprising a plurality of segments 510 connected by elbows 512, 122. The base 502 is in the shape of a pentagon, however, in other embodiments, a base can be a different shape, such as a different polygon, circular or elliptical, for example. The base 502 includes a plurality of weight holders 112 configured to at least assist in securing a weight to or about the base 502. As discussed above, during operation, the inclusion of a weight(s) may assist in stabilizing and/or generally retaining the position of the jump training apparatus 500 during operation.

In the embodiment shown in FIG. 5, the base 502 is operably connected to a sleeve 504 that includes an opening 511. At least a portion of the sleeve 504 can be generally perpendicular to the base 502. The sleeve 504 is configured to slidably receive a pipe 506 that is operably connected to an arm 110 using an elbow 124. In certain embodiments, for example, a sleeve can be configured to be slideably received inside a pipe. At least a portion of the arm 110 can be generally parallel to the base 502. A cushion 118 is disposed on the arm 110. The pipe 506 includes a handle 514 extending therefrom configured to extend through the opening 511 in the sleeve 504. Sliding the handle 514 away from the base 502 such that the handle 514 traverses the opening 511 in a first direction can raise the pipe 506, thereby raising the arm 110. Sliding the handle 514 toward the base 502 such that the handle 514 traverses the opening 511 in a direction opposite the first direction can lower the pipe 506, thereby lowering the arm 110.

In the embodiment shown in FIG. 5, the position of the pipe 506 relative to the sleeve 504 can be secured using the handle 514 and a serrated portion 516 that includes a plurality of slots 517 (also shown in FIG. 6) about the opening 511 of the sleeve 504. In this embodiment, the handle 514 includes a spring that biases the handle 514 toward the sleeve 504, thereby securing the handle 514 in opposing slots 517 of the serrated portion 516 and securing the pipe 506 in position relative to the sleeve 504. In order to move the pipe 506 relative to the sleeve 504, the handle 514 can be manipulated away from the sleeve 504, thereby compressing the spring such that the handle 514 disengages the slots 517 and the handle 514 is free to traverse the opening 511. In other embodiments, the position of the pipe 506 relative to the sleeve 504 can be secured using other methods described herein in connection with other embodiments.

In the embodiment shown in FIG. 5, for example, the sleeve 504 includes a height indicator 518. The height indicator includes markings that can indicate vertical distance from the bottom of the base 502. In certain embodiments, for example, using a height indicator 518 can facilitate monitoring and/or recording the vertical distance of a user's jump.

In the embodiment shown in FIG. 5, the floor standing jump training apparatus 500 includes a plurality of support arms 520. The support arms 520 extend from the base 502 to the sleeve 504. The support arms 520 are configured to provide improved stability. In the embodiment shown, one support arm 520 extends from the apex 522 of the pentagon-shaped base 502 to the sleeve 504, and two support arms 520 extend from the corners 524 of the pentagon-shaped base 502 to the top of the sleeve 504. In other embodiments, for example, any number of support arms, including a single support arm, can extend from a base to a sleeve in any desired configuration. Further, in certain embodiments, one or more weight holders 112 can be disposed on a support arm(s).

In the embodiment shown in FIG. 5, a ball 530 attached to a rope 532 is removably attached to the arm 110. As shown, a first end of the rope 532 is attached to the ball 530 and a second end of the rope 532 provides a loop 534 that san be slid over the arm 110 and the cushion 118. In certain embodiments, for example, providing a ball on a rope as described may provide a deflectable target as opposed to a rigid target. In certain embodiments, for example, a deflectable target can improve safety and/or allow for the target to be contacted with a jumper's head rather than the jumper's hand.

Figure 6:
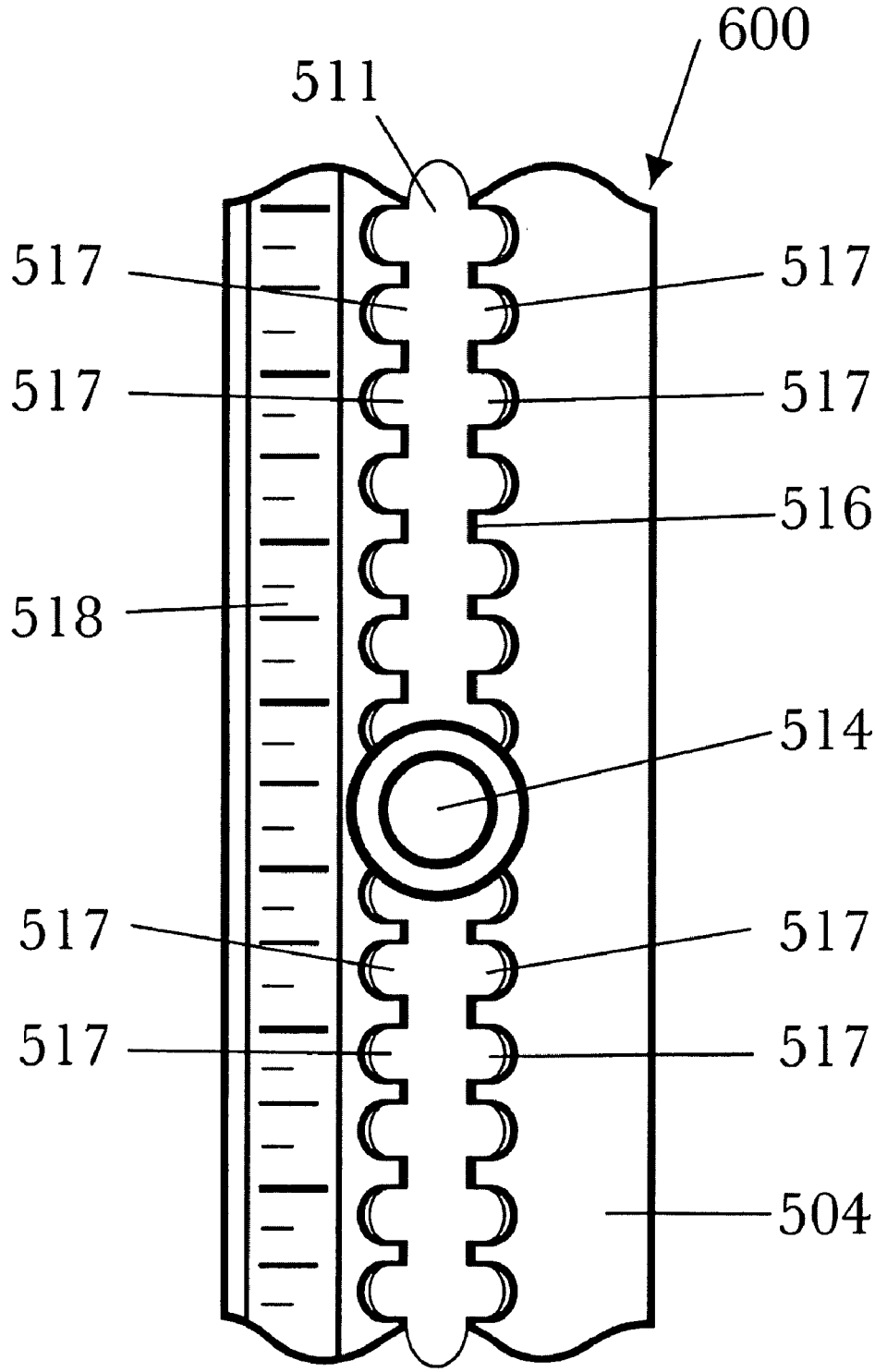
FIG. 6 illustrates an adjustment member for a jumping apparatus according to one embodiment of the present invention.

FIG. 6 illustrates an adjustment member 600 for a jumping apparatus according to one embodiment of the present invention. The adjustment member 600 shown in FIG. 6 is the same mechanism shown and described in connection with FIG. 5.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. A jump training apparatus comprising:

a pipe including a first end, a second end and a handle;

a sleeve including an opening extending lengthwise along the sleeve, the sleeve configured to slideably engage the first end of the pipe such that the handle extends through the opening and can traverse the opening, the opening including a serrated portion comprising slots disposed on opposing sides of the opening to provide a plurality of slot positions along the opening, wherein the handle is spring loaded such that a spring biases the handle into engagement with the serrated portion, thereby securing the pipe relative to the sleeve in one of the slot positions along the opening, and wherein compressing the spring can disengage the handle from the serrated portion, thereby allowing the handle to traverse the opening; and an arm extending from the second end of the pipe, wherein sliding the pipe relative to the sleeve such that the handle traverses the opening can vary the height of the arm.

2. The apparatus of claim 1, further including a base, wherein the sleeve extends from the base.

3. The apparatus of claim 2, wherein the sleeve is substantially perpendicular to the base.

4. The apparatus of claim 2, wherein the base comprises a plurality of segments, and wherein the base is at least one of: polygonal shape, circular shape and elliptical shape.

5. The apparatus of claim 2, further including a weight holder extending from the base.

6. The apparatus of claim 2, further including a support arm extending from the base to the sleeve.

7. The apparatus of claim 1, further including a mounting element configured to attach the sleeve to a vertical surface.

8. The apparatus of claim 7, wherein the mounting element comprises a bracket.

9. The apparatus of claim 1, further including a cushion disposed on the arm.

10. The apparatus of claim 1 further including a deflectable target.

11. The apparatus of claim 10, wherein the deflectable target is removably attachable to the arm.

12. The apparatus of claim 11 wherein the deflectable target comprises a ball on a rope.

13. The apparatus of claim 1, further including a height indicator disposed on the sleeve, wherein the height indicator includes markings that indicate vertical distance, and wherein the height indicator is disposed along a side of the opening.

* * * * *